US009115542B1

(12) United States Patent
Calvert

(10) Patent No.: US 9,115,542 B1
(45) Date of Patent: Aug. 25, 2015

(54) GEO-DIVING DEVICE

(71) Applicant: HP Associates, Trustee for HPCC CRT Trust, Manassas, VA (US)

(72) Inventor: S. Mill Calvert, Manassas, VA (US)

(73) Assignee: GDD Associates, Trustee for Geo-diving device CRT Trust, Manassas, VA (US)

( * ) Notice: Subject to any disclaimer, the term of this patent is extended or adjusted under 35 U.S.C. 154(b) by 0 days.

(21) Appl. No.: 14/686,518

(22) Filed: Apr. 14, 2015

(51) Int. Cl.

| | |
|---|---|
| ***E21B 7/26*** | (2006.01) |
| ***E21B 49/00*** | (2006.01) |
| ***E21B 7/06*** | (2006.01) |
| ***E21B 7/20*** | (2006.01) |
| ***E21B 17/05*** | (2006.01) |
| ***E21B 4/04*** | (2006.01) |

(52) U.S. Cl.
CPC . *E21B 7/205* (2013.01); *E21B 4/04* (2013.01); *E21B 7/06* (2013.01); *E21B 7/26* (2013.01); *E21B 49/003* (2013.01); *E21B 17/05* (2013.01)

(58) Field of Classification Search
CPC ..... E21B 7/26; E21B 7/06; E21B 7/205; E21B 4/04; E21B 4/145; E21B 17/05
See application file for complete search history.

(56) References Cited

U.S. PATENT DOCUMENTS

| | | | | | |
|---|---|---|---|---|---|
| 1,372,317 | A | * | 3/1921 | Saliger | 175/21 |
| 1,388,545 | A | * | 8/1921 | Bohan | 175/19 |
| 2,207,536 | A | * | 7/1940 | Dunkum | 299/56 |
| 3,326,008 | A | * | 6/1967 | Baran et al. | 405/184 |
| 3,375,885 | A | * | 4/1968 | Scott et al. | 175/26 |
| 3,554,300 | A | * | 1/1971 | Rosenberg | 175/5 |
| 3,630,295 | A | * | 12/1971 | Coyne et al. | 175/73 |
| 3,767,263 | A | * | 10/1973 | Gootee | 299/33 |
| 3,794,128 | A | * | 2/1974 | Gagen et al. | 175/73 |
| 3,865,200 | A | * | 2/1975 | Schmidt | 175/19 |
| 4,592,432 | A | * | 6/1986 | Williams et al. | 175/26 |
| 4,726,711 | A | * | 2/1988 | Tian | 405/184 |
| 4,886,128 | A | * | 12/1989 | Roemer | 175/19 |
| 4,905,773 | A | | 3/1990 | Kinnan | |
| 4,974,688 | A | * | 12/1990 | Helton | 175/73 |
| 5,311,950 | A | * | 5/1994 | Spektor | 175/19 |
| 5,322,391 | A | | 6/1994 | Fisk | |
| 5,505,270 | A | * | 4/1996 | Wentworth | 173/1 |
| 5,794,718 | A | * | 8/1998 | Zollinger et al. | 175/19 |
| 6,176,325 | B1 | * | 1/2001 | Rodger | 175/50 |
| 6,488,105 | B1 | * | 12/2002 | Wilcox | 175/298 |
| 7,055,625 | B1 | * | 6/2006 | Myrick et al. | 175/26 |
| 8,061,441 | B2 | * | 11/2011 | Yasuda | 175/26 |
| 8,196,681 | B2 | * | 6/2012 | Bick | 175/323 |

(Continued)

FOREIGN PATENT DOCUMENTS

WO WO 2011123918 A1 * 10/2011

*Primary Examiner* — Jennifer H Gay
(74) *Attorney, Agent, or Firm* — Louis Ventre, Jr.

(57) ABSTRACT

An automated device digs a payload into a geologic formation while filling a hole behind it. The device is made of components including a computer controller; a battery; a motor; a payload body; a drill head having a spiral blade; a cylindrical shell attached to the payload body to form an annulus between an inner wall of the cylindrical shell and the outer wall of the payload body; and a plurality of rotating track treads controlled by the computer controller. The device optionally includes: a hydraulic ram adapted to compress debris; a coil of wire adapted to unwind from the top end of the payload body; a hammer blade; ground penetrating radar; a gimbal mechanism; an engine-generator unit; and a cave traverse system.

8 Claims, 6 Drawing Sheets

(56) References Cited

U.S. PATENT DOCUMENTS 8,944,186 B2 2/2015 Kocis et al.
2009/0188137 A1* 7/2009 Yasuda ..... 37/350
2009/0301779 A1* 12/2009 Bick ..... 175/45
2013/0051919 A1* 2/2013 Andres et al. ..... 405/159
2014/0290554 A1* 10/2014 Brizard ..... 114/331

* cited by examiner

GEO-DIVING DEVICE

TECHNICAL FIELD

In the field of devices for penetrating the earth or geologic formation without extraction of all of the material from a borehole, an apparatus that includes means peculiar to displacing material to form a borehole while refilling the borehole above the apparatus while the apparatus is in the earth or geologic formation.

BACKGROUND ART

Many of the answers that mankind and scientists are searching for lay deep underground in various layers that have formed over many millions of years. These inaccessible areas continue to hide the answers and proofs that many scientists and researchers seek.

In addition, in support of exploration of the planetary bodies in our solar system, it will be necessary to install a measurement unit, such as a lunar seismometer for measuring moonquakes, within the lunar surface. In order to isolate the seismometer from solar radiation and the extremes of heat and cold, it will be necessary to sink the seismometer into the regolith without leaving a hole above the unit for intrusion from the surface of the complicating ambient conditions.

In support of research on deep geologic formations, the way that scientists can sometimes try to access a small amount of this otherwise inaccessible material for analyses is to drill and bring up a core sample of the material. In some locations, core sampling is considered impractical or even destructive of the condition sought to be measured. Even if scientists can obtain a small core sample, their act of removing this material from its underground location will often change the material and contaminate the answers being sought.

It is a known uncertainty of physics and science that the act of retrieving and moving a material to observe it could change the properties of the material. By bringing a core sample out of the earth to a laboratory, the sample is subject to changes in ambient pressure, temperature, moisture content, and structure. The core sample is now in an altered state due to a changed relationship with other ground materials, the level of magnetism and other earth energies that pass through it, the exact directional position in the ground, the exposure to sunlight and artificial light, and a whole host of various electric magnetic pollution and signals and gases and toxins, etc.

SUMMARY OF INVENTION

A device digs a payload into a geologic formation while filling a hole behind it. The device is made of components including a computer controller; a battery supplying power to the computer controller; a motor powered through the battery and controlled by the computer controller; a payload body defining an enclosed hollow internal structure adapted to contain and support the components; a drill head having a spiral blade; a cylindrical shell attached to the payload body and having an inner diameter larger than the outer diameter and extending from the bottom of the payload body to surround the payload body, the cylindrical shell forming an annulus between an inner wall of the cylindrical shell and the outer wall of the payload body; and a plurality of rotating track treads controlled by the computer controller. The annulus is the path of debris from the spiral blade.

The device optionally includes: a hydraulic ram adapted to compress debris exiting from the annulus a coil of wire adapted to unwind from the top end of the payload body; a hammer blade extendable from a slot in the drill head; ground penetrating radar controlled by the computer controller; a gimbal mechanism mounted between the motor and the pointed end of the drill head and adapted to tilt the drill head upon a command received from the computer controller; an engine-generator unit within the payload body; a cave traverse system that includes a sensor to indicate when the drill head has entered a void space; spikes adapted to be deployed into the geological formation; a cable attached to each of the spikes and anchored to the payload body; and a spool holding the cable and adapted to unspool the cable as the payload body descends into the void space.

Technical Problem

There needs to be a system to analyze the material in a deep geologic formation without altering the ambient conditions seen by this material in the formation. The system needs to easily bring the scientific laboratory and testing materials directly to the underground location of the material.

Solution to Problem

The solution to this problem is the geo-diving system. The geo-diving system is a fully automated self-contained deep drilling robot that is computer controlled and can easily deliver a payload of scientific test or other materials to a selected depth and location.

The preferred embodiment of the geo-diving system has a cylindrical shape and sticking out of the very bottom is a drill-head with a blade configuration that can be used as a hammer drill blade or as a regular auger type blade to cut into softer earth.

Near the top of the geo-diving system there may be rigging loops for lifting and/or handles to hold up the unit while starting its initial dig into the geologic formation. There may be a flip-up lid or side doors that enable access to the payload body, for example, access to a keypad and computer controller.

The computer controller is preferably pre-programmed for operational tasks. For example, it may be used to select a depth which can be selected to drill to and a time to energize the payload components. A great deal of operational data instructions may be loaded into the computer if needed so the unit can be directed to perform all desired experiments or work.

The center of the payload body has a large payload capacity where various desired scientific test equipment, materials, and other experimental devices can be placed. Once the unit digs into the ground, a series of moving traction-tread belts grip the geological formation to push the unit downward or send it in an altered direction.

The preferred unit can make a single straight down core hole or the computer can be programmed to make it follow a preselected drill path. All of the pulverized rock and drilling debris is pushed back up out the top of the unit and it backfills the hole, so when it reaches the desired site, there will be no open hole above where sunlight and various toxins and surface factors could corrupt the specific material at the desired geologic site.

Advantageous Effects of Invention

Now scientists will be able to run a large variety of tests in almost any deep geologic location. The proof that has been sought for various global warning, climate change, and environmental issues can now be obtained with the ability to run the tests and experiments deep underground or deep within a glacier in Antarctica. An apparatus enabling in situ research will greatly advance science and mankind's understanding of the earth or other planetary geology. On earth, it can help explain the effect that large populations and their demands have placed on the changing earth.

With the geo-diving system, scientists can now pursue a whole line of new experimentation and research that has never been possible before.

The geo-diving system can easily go to tectonic plates and fault lines and conduct experiments to accurately predict when earthquakes may occur and their magnitude.

The geo-diving system can go into volcanoes and help scientists be able to predict when they will become active or dangerous.

The geo-diving system can go under the ocean floor or bodies of water to measure man's pollution and toxins that are effecting marine life.

The geo-diving system can go in the ground below landfills to measure environmental concerns.

The geo-diving system can measure effects of pollution on deep underground water tables.

There is really no limit to the amount of testing and research that can now be accomplished with the geo-diving system.

The geo-diving system can also be used for conventional exploration needs. It can locate vast new underground water supplies, oil and natural gas reserves, locate gold, silver, and other desirable mining minerals.

The geo-diving system can even be used for very simple tasks like locating the best location to drill a well.

The geo-diving system is a valuable and needed tool which can help man to preserve and protect our precious earth and life or explore the planetary bodies in our solar system.

BRIEF DESCRIPTION OF DRAWINGS

The drawings illustrate preferred embodiments of the geo-diving system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
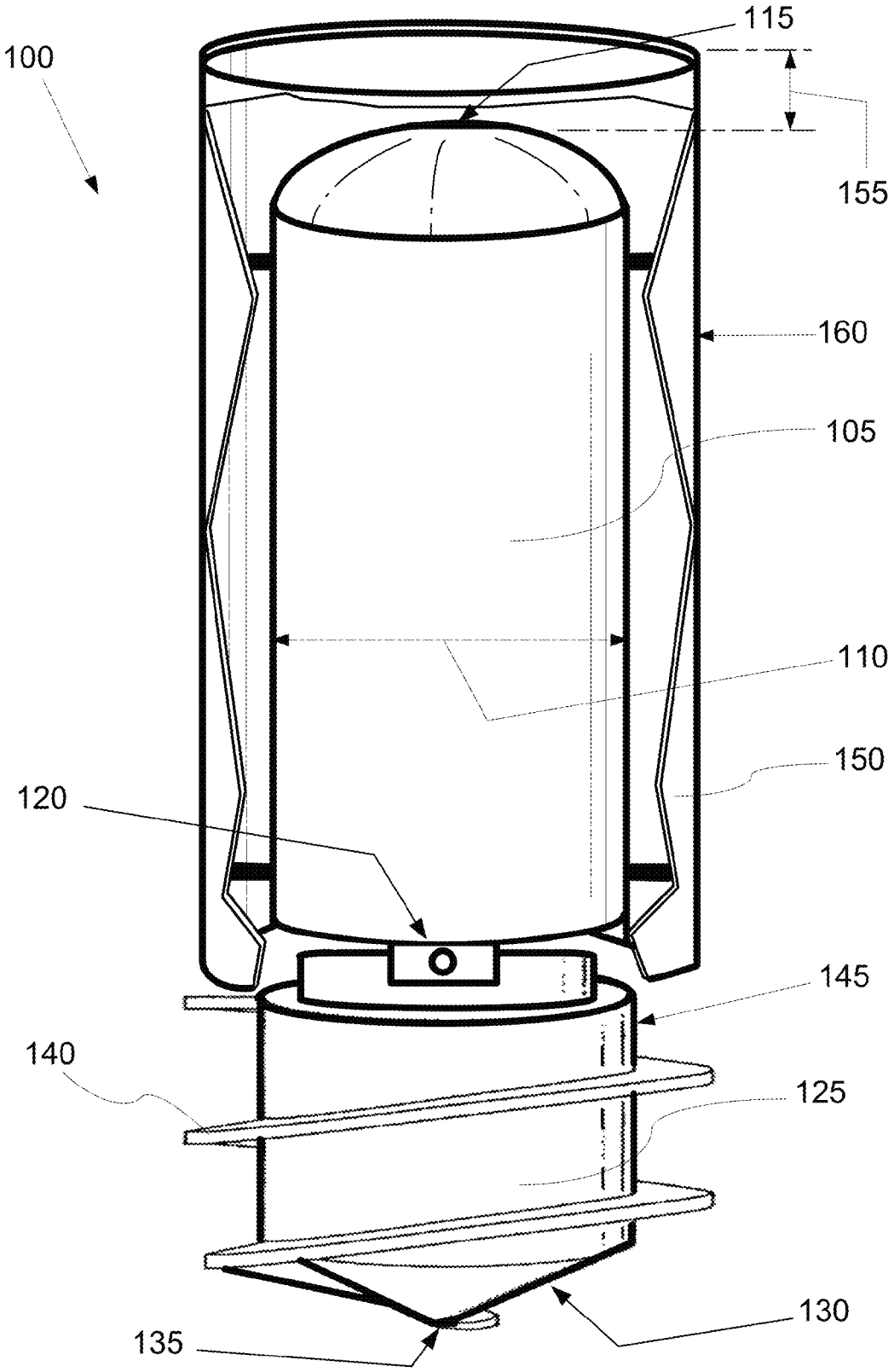
FIG. 1 is an elevation view of the geo-diving system with a cutaway of the cylindrical shell showing the payload body within.
Figure 6:
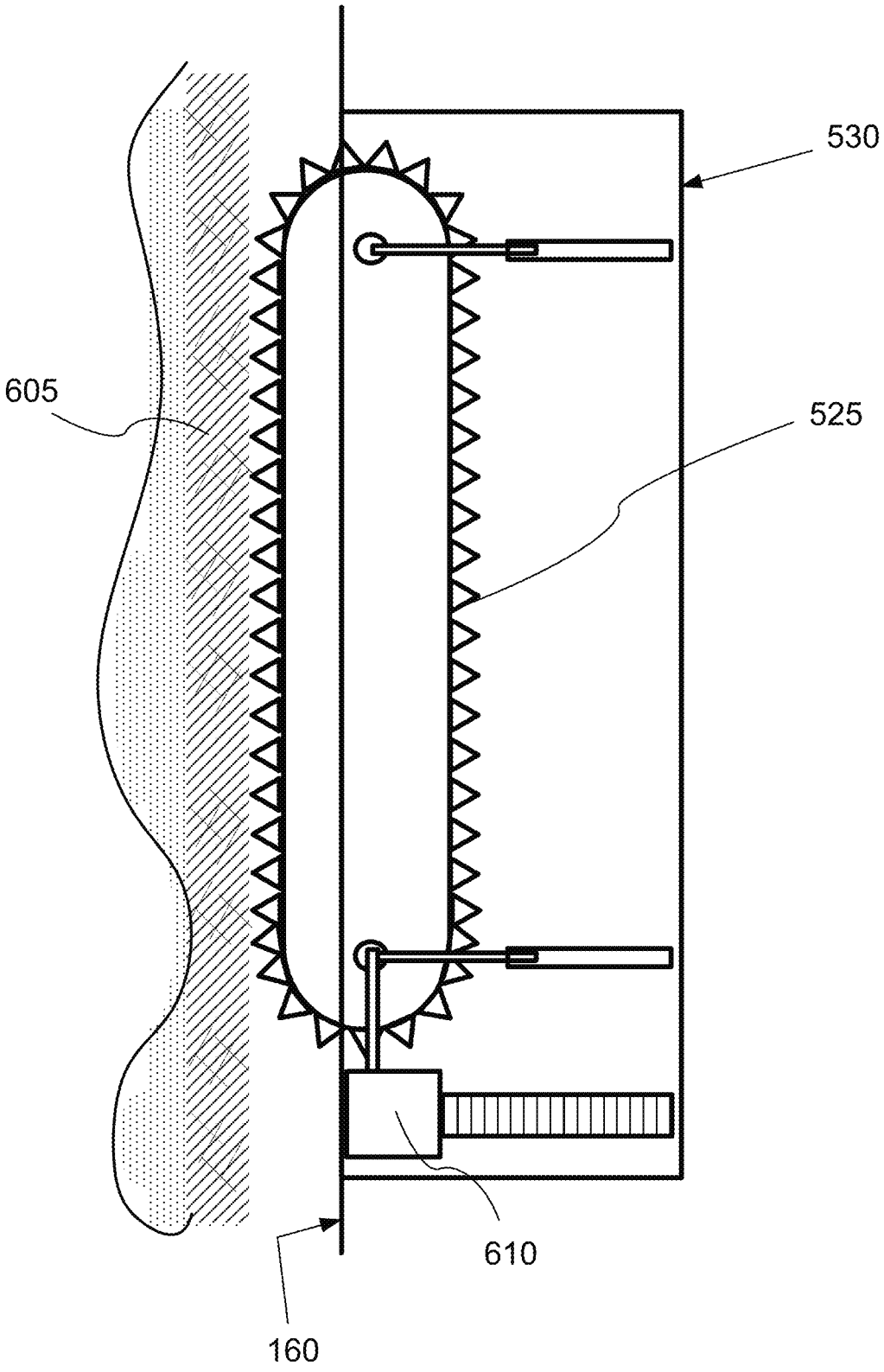
FIG. 6 is a side elevation view of one of the recesses in the cylindrical shell with an extendable rotating track tread telescoped into engagement with the geologic formation.
Figure 7:
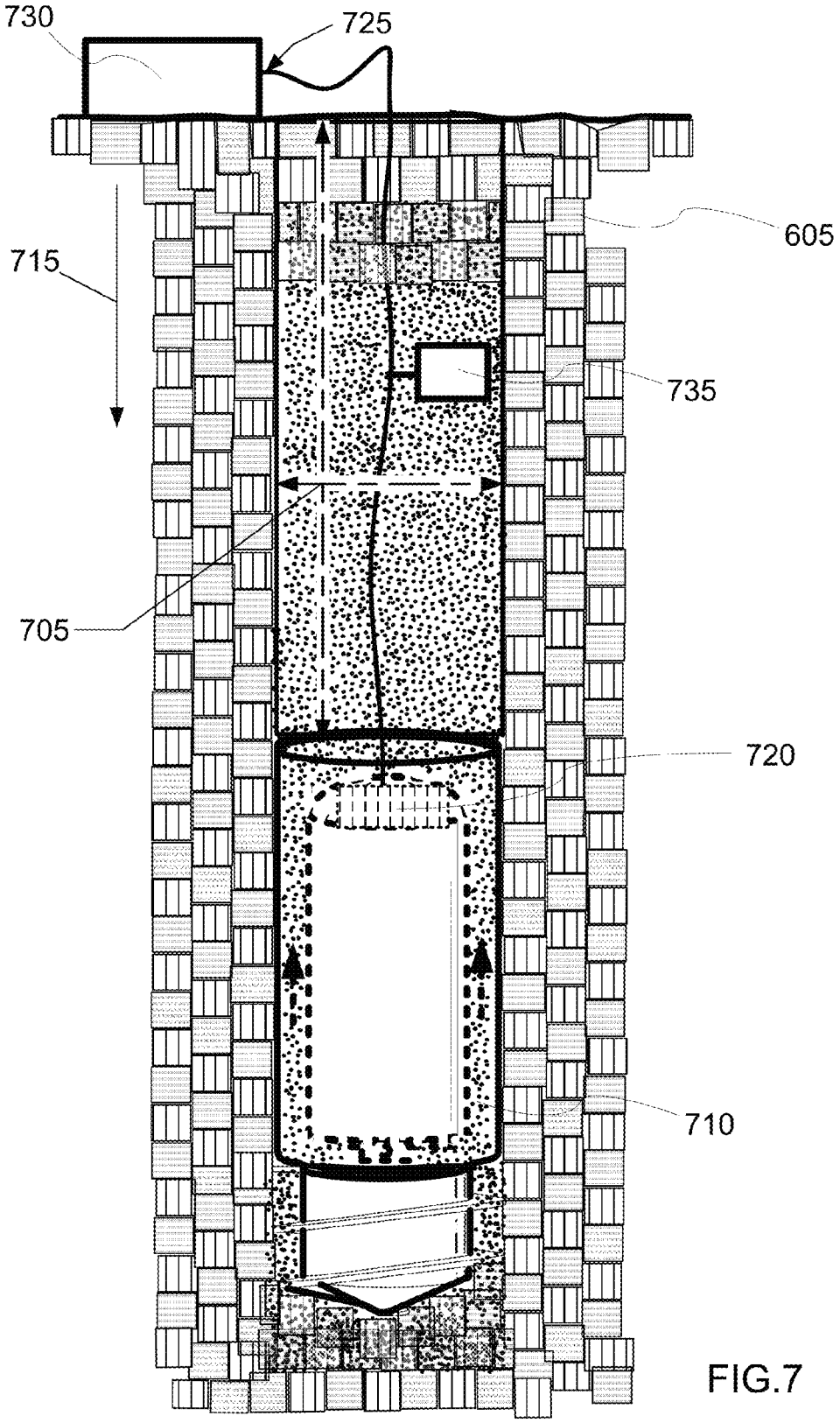
FIG. 7 is a side elevation view of the geo-diving system within a geological formation and illustrating an embodiment having an unspooled wire up to a buried power supply and an above-ground control and power supply.

FIG. 1 is an elevation view of the device (100), which is also referred to as a geo-diving system. The device (100) digs a payload (205), shown in FIG. 2, into a geologic formation (605), shown in FIG. 6, while filling a hole (705), shown in FIG. 7, behind the device (100). A preferred embodiment of the device (100) includes a computer controller (210), a battery (215), a motor (220), a payload body (105), a drill head (125), a cylindrical shell (150), and a plurality of rotating track treads (525), shown in FIG. 5.

Figure 5:
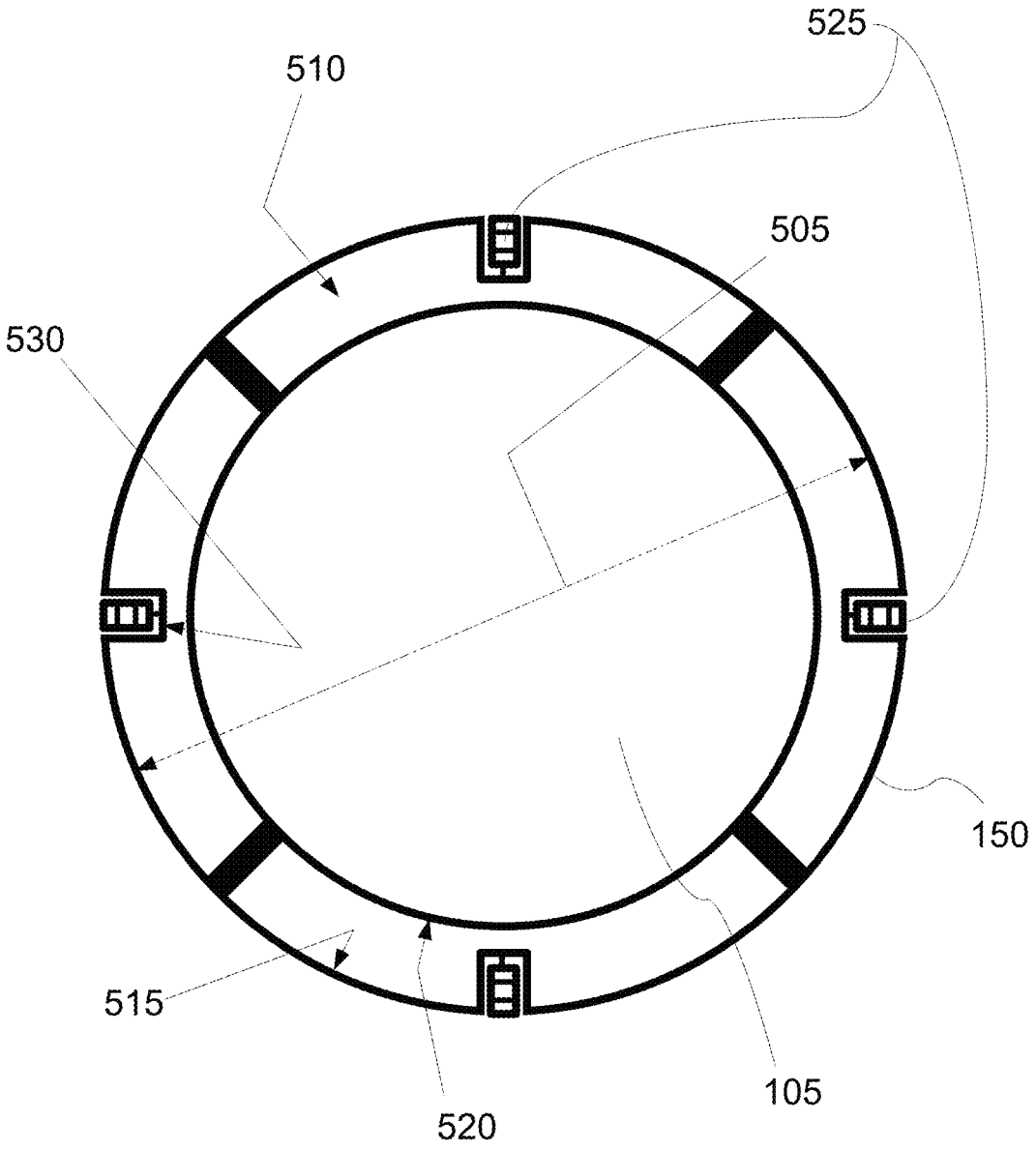
FIG. 5 is a top view of the annulus formed between the payload body and the cylindrical shell and illustrating four extendable rotating track treads each within a recess defined by the cylindrical shell.

In FIG. 1, the cylindrical shell (150) is depicted in a cutaway in order to show the payload body (105) within. FIG. 5 shows a top view of the cylindrical shell (150) in the form of a right-circular cylindrical body surrounding the payload body (105), also a cylindrical body. The use of a cylindrical form is preferred for both the cylindrical shell (150) and the payload body (105) because this form minimizes the frictional forces acting against downward propulsion of the device (100). The payload body (105) is preferably waterproof to prevent damage to the internal components from liquids that may be present in the geologic formation (605). The payload body (105) is also preferably sealed to avoid exposing the geologic formation (605) to any battery or machinery sparks that could ignite gases in an oxidizing environment.

One preferred use of the device (100) is to send a payload of instruments below the surface of a geological formation (605), whether on Earth or another planetary body. An off-world example is the scientific study of the regolith of Jupiter's moon Europa. The device (100) is referred to a geo-diver because, like a swimmer who dives in water, the device (100) digs into the geological formation, filling in the hole behind it, similar in effect to the water closing in behind the diver. Backfilling the hole prevents contamination from the surface of the formation adjacent to the device (100).

The computer controller (210) is the brains of the device (100). The computer controller (210) includes a central processing unit, non-transitory memory for storage of program information concerning the operation of the payload (205), e.g. instruments, within the payload body (105), and any operational data obtained by the device (100) or any of its components. The program information is computer code for controlling the battery (215), the motor (220), the payload (205), the drill head (125), the plurality of rotating track treads (525), and any other component added to the device (100) in support of a sub-surface mission. Preferably, one or more doors (255) in the payload body (105) provide the means to access the internal compartments and components within the payload body (105). The computer controller (210) and any instruments within the payload body (105) may be isolated from the device (100) by shock absorbency mounts to minimize the potential for deleterious drill head vibrations or other adverse operational conditions.

The battery (215) supplies power to the computer controller (210). It is preferably a central power supply for operation of the device (100), including the components within the device (100). The battery (215) is preferably a high-energy density rechargeable electrochemical battery, such as a lithium ion. Alternatively, a non-rechargeable battery, such as an aluminum-air battery, may be used where high energy density and limited lifetime uses are involved.

The motor (220) drives the drill head (125) and is powered through the battery (215). The words "through the battery" are meant to explain that the battery (215) may not be the only source of power for the drill head (125). Rather the battery (215) supplies the power for the motor and/or the battery (215) serves as an intermediary or pass-through device with power supplied from another power source, such as a generator, secondary batteries, or electric power sent from the surface. Operation of the motor (220) is controlled by the computer controller (210).

The payload body (105) is a container for the payload and other operational components. The payload body (105) defines an enclosed hollow internal structure adapted to contain and support a payload (205), the computer controller (210), the battery (215) and the motor (220). For purposes of better explaining the structural connectivity with other components of the device (100), it is observed that the payload body (105) has an outer diameter (110), a top end (115) and a bottom end (120).

The drill head (125) has at least one section that has a conical shape (130) rising from a pointed end (135). The pointed end (135) is preferably the lowest section that first engages the geologic formation and creates the debris (710) from the geological formation (605). The drill head (125) is rotatably mounted to the motor (220) at the bottom end (120) of the payload body (105). The motor (220) turns the drill head (125) and drills into the geological formation (605). The drill head (125) includes a spiral blade (140) on an outer peripheral surface (145) of the conical shape (130). The spiral blade (140) may rise to other portions of the drill head (125). The spiral blade (140) starts at the pointed end (135) and rises toward the payload body (105). In an alternative embodiment, the payload body (105) includes an external auger blade rotating within the annulus to aid in lifting debris (710).

The cylindrical shell (150) is attached to the payload body (105). Because the cylindrical shell (150) surrounds the payload body (105), the cylindrical shell (150) has an inner diameter (505) that is larger than the outer diameter (110) of the payload body (105). The cylindrical shell (150) is dimensioned so as to extend from the bottom of the payload body (105) where the debris rises from the spiral blade (140) to surround the payload body (105). Preferably, the cylindrical shell (150) terminates near the top end (115) of the payload body (105) to better direct the flow of debris (710). The top of the cylindrical shell (150) is preferably at the same level as the top end (115) of the payload body (105) so that any ram action to compress the debris field can take place with only sideway action from the top end (115) of the payload body (105).

If the cylindrical shell (150) extends above the payload body (105), then there is no preferred position (155) above the top end (115) of the payload body (105) so long as the debris (710) is channeled through the annulus (510) to exit above the payload body (105). The passageway between the payload body (105) and the cylindrical shell (150) is the annulus (510). The annulus (510) is formed between the inner wall (515) of the cylindrical shell (150) and the outer wall (520) of the payload body (105). The spiral blade (140) delivers debris (710) into the annulus starting at the bottom end (120) of the payload body (105). Thus, the annulus (510) is configured in size and entry shape to receive debris (710) from the spiral blade (140). In an alternative embodiment, a vacuum system sucks up debris (710) and deposits it above the device (100).

The plurality of rotating track treads (525) is controlled by the computer controller (210). The plurality of rotating track treads (525) is mounted vertically to the cylindrical shell (150) and adapted to extend radially outward from within a recess (530) of an outside wall (160) of the cylindrical shell (150). Preferably, the recesses are symmetrically placed along the outside wall (160).

Each rotating track tread extends outwardly from the recess (530) in the wall of the cylindrical shell (150) to engage the geologic formation (605) for either an upward push to release the pressure on the drill head (125), or downward push to cause the drill head (125) to bite into the geological formation (605). Preferably, extending and rotating each rotating track tread is independently operable by the computer controller (210) using drive gearing (610) for each such rotating track tread. In some embodiments, the plurality of rotating track treads (525) must at least exert a push on the drill head (125) in a downward direction (715). Preferably, each rotating track tread may be engaged separately for either an upward or downward traction so as to shift the path of the device (100). The rotating track treads (525) also serve to prevent counter rotation of the payload body (105) and the cylindrical shell (150) in reaction to the rotation of the drill head (125). A sensor indicating tread revolutions provides a means for the computer controller (210) to determine how far down the device (100) has traveled in the downward direction (715).

In an alternative embodiment, mini hydraulic feet mounted above the drill head (125) are individually activated by the computer controller (210) to push out sideways, providing added force for changing the path of the device (100).

For very soft sandy surface soil, an alternative embodiment may include tread guide rails that are sledge hammered into the ground to give the device (100) the ability to push down until the rotating track treads (525) reach solid ground.

Figure 2:
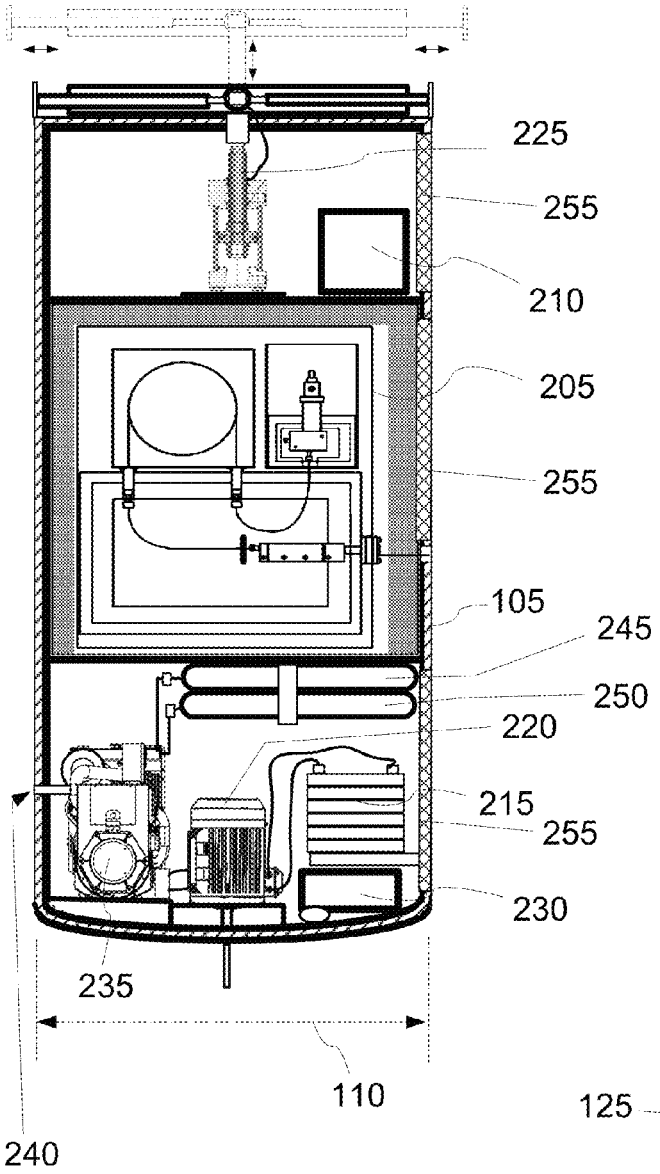
FIG. 2 is a sectional elevation view of the payload body.
Figure 3:
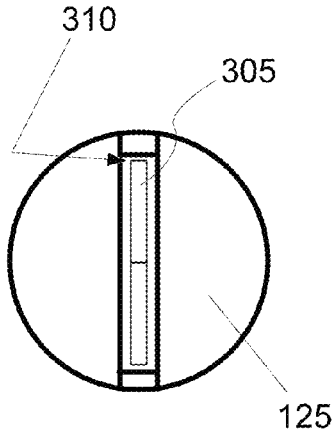
FIG. 3 is an end view of a hammer blade within a drill head.

In some embodiments, the device (100) includes a hydraulic ram (225) that can compact the debris exiting the annulus (510) into the space above the device (100). Operation of the hydraulic ram (225) is controlled by the computer controller (210). Sensors indicating the drill head (125) torque or debris density provide input for determining when to activate the hydraulic ram (225). The hydraulic ram (225) preferably can extend sideways into the wall of the geologic formation (605) and upward into the debris field above the device (100). As shown in FIG. 2, the hydraulic ram (225) preferably extends from the top end (115) of the payload body (105), the hydraulic ram (225) adapted to compress debris (710) exiting from the annulus (510). In alternative embodiments an air compressor may be used to inject compressed air into the annulus to improve the flow of debris (710). In yet other embodiments, the payload body (105) includes a polymer solution that is sprayed onto debris (710) as the debris (710) is pushed to exit above the payload body (105). The polymer solution hardens the debris (710) and holds it in place.

In some embodiments, the device (100) includes a coil of wire (720) adapted to unwind from the top end (115) of the payload body (105) as the device (100) descends into the geologic formation (605). The device (100) is then a tethered machine.

The wire is any electrical conductor suitable for powering the device (100) and exchange control signals with the device (100). Preferably, the wire is connected so as to provide electrical power to the battery (215) and the motor (220). An above-ground control and power supply (730) on the surface may be used with the wire to supply power to the device (100) and serve as an interface to send instructions to the computer controller (210).

Alternatively, the wire may connect to extra battery packs such as a buried power supply (735) located near the entry point into the geological formation (605). The wire is, therefore both a power line and a communications link. The wire is preferably adapted to provide a connection (725) for sending instructions to the computer controller (210). Preferably, an untethered machine would not be in communication with anyone on the surface and would be fully automated. In an alternative embodiment, communication with an untethered machine could be undertaken by sending a signal through the geologic formation to a signal receiver on the device (100).

In some embodiments, the device (100) includes a hammer blade (305) extendable from a slot (310) in the drill head (125). Working like a jack hammer, the hammer blade (305) adapted to be rapidly extended in and out of the drill head (125) so as to engage the geologic formation (605) and pulverize rock. Rapid hammering by the hammer blade (305) may be activated by the computer controller (210) independently of the rotation of the drill head (125). In alternative embodiments, a hammer blade (305) clutch automatically senses a certain downward pressure level and activates. In yet other embodiments the hammer blade (305) has a masonry blade edge that consists of multiple blade edges layered together so that when one wears down another blade edge is exposed.

In some embodiments, the device (100) includes ground penetrating radar (230) controlled by the computer controller (210). The ground penetrating radar (230) is used to assess the density of the geologic formation (605) below the drill head (125) and determine if course correction is needed.

Figure 4:
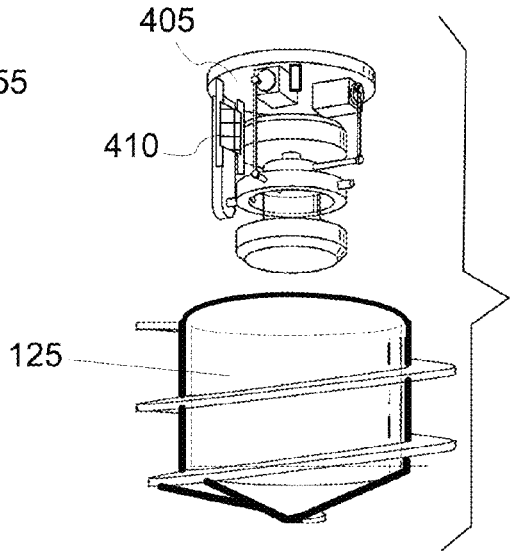
FIG. 4 is a perspective view of a hollow drill head with a gimbal for directional drilling and a coolant mixer.

In some embodiments, the device (100) includes a gimbal mechanism (405) mounted between the motor (220) and the pointed end (135) of the drill head (125) and adapted to tilt the drill head (125) upon a command received from the computer controller (210). The gimbal mechanism (405) preferable fits within a hollow drill head as shown in FIG. 4. In some embodiments the shaft connecting the motor (220) to the drill head (125) can telescope out when drill head (125) turns directions.

Working in conjunction with the plurality of rotating track treads (525), the gimbal mechanism (405) can enhance the ability of the device (100) to change its path. In preferred embodiments, the angle of attack of the drill head is changed in the manner of directional drilling known in the oil drilling industry. The device (100) can be programmed to go down in swirl or zigzag pattern to lessen the weight of displaced debris atop of the device (100). In alternative embodiments, the payload body (105) and the cylindrical shell (150) are made of flexible material so that the device (100) has a "Snake Flex Body" to curve around angle and curve cuts. The computer controller (210) can be programmed to produce any directional cutting path, but also to autonomously respond to difficult geology detected by on-board sensors by altering the cutting path as may be needed. As further examples, the device (100) may include: a metal detector to tell computer controller (210) if a high metal content rock is ahead, a gyroscope to keep it steady or upright, gravity sensors to indicate up and down directions, and a telescoping camera or light probe to photograph the geology.

When a hollow drill head is used, there may also be a coolant mixer (410) controlled by the computer controller (210). The coolant mixer (410) is essentially two separate bottles each holding a chemical that when combined cause an endothermic reaction, similar to the technology in an instant cold pack. The computer controller (210) receiving drill head temperature reading from a sensor activates the coolant mixer (410) to combine the two chemicals. This cools down the chemical mixture which absorbs heat from the drill head (125). The coolant mixer (410) works like a commercial cold pack, which is a flexible bag within a bag. The commercial cold pack consists of two bags; one holding water, inside a bag holding ammonium nitrate, calcium ammonium nitrate or urea. When the inner bag of water is broken by squeezing the package, it is allowed to dissolve the solid in an endothermic reaction. This reaction absorbs heat from the surroundings, quickly lowering the pack's temperature.

In some embodiments, the device (100) includes an engine-generator unit (235) within the payload body (105). The engine-generator unit (235) is configured to generate electricity and supply power to the battery (215) upon activation by the computer controller (210). The engine-generator unit (235) has a gaseous exhaust (240) outside the payload body (105), which will tend to soften the geologic formation (605). These embodiments also include a fuel tank (245) within the payload body (105). The fuel tank (245) is adapted to supply fuel to the engine-generator unit (235). These embodiments also include an oxygen tank (250) within the payload body (105). The oxygen tank (250) is adapted to supply oxygen to the engine-generator unit (235).

Figure 8:
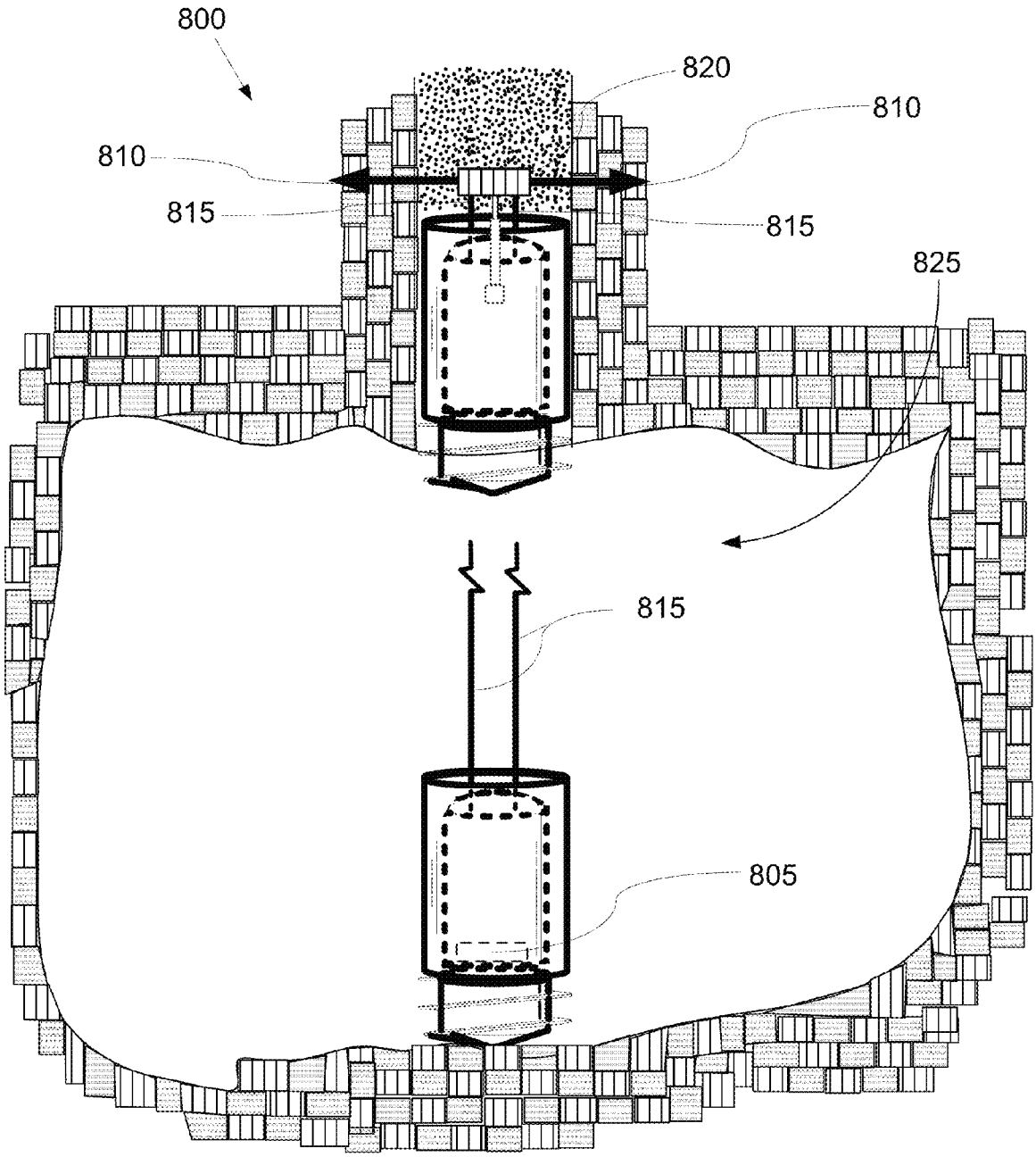
FIG. 8 is an illustration of a cave traverse system for lowering the geo-diving system through a below ground cave.

In an alternative embodiment illustrated in FIG. 8, the device (100) includes a cave traverse system (800) that permits the device (100) to lower itself in an upright configuration from the entry point into the cave to the cave floor. The cave traverse system (800) includes a sensor (805), at least two spikes (810); a cable (815); and a spool (820).

The sensor (805) is connected to the computer controller (210). The sensor (805) may be any indicator that reflects entry into a void space (825). For example, the sensor (805) could be a drill head (125) speed indicator or a camera or laser and light meter combination projecting outward from the payload body. The sensor (805) is one that is adapted to indicate when the drill head (125) has entered a void space (825).

The at least two spikes (810) are adapted to be deployed into the geological formation (605) at about 90 degrees from the downward direction (715) of the payload body (105). Such deployment occurs after the sensor (805) has indicated to the computer controller (210) that the drill head (125) has entered the void space (825). The computer controller (210) may also take other actions consistent with the deployment of the spikes, such as first stopping any downward self propulsion of the device (100) so that the spikes can be deployed before the device (100) falls into the cave. In some embodiments the spikes are part of a hydraulic system that is raised from within the payload body (105) upon command from the computer controller (210) and then the spikes are deployed sideways into the geologic formation (605). In other embodiments, side access ports open and the spikes deploy through the side access ports. Sideways deployment of the spikes may be any practical means, such as by explosive charge or simply further hydraulic action.

There is a cable (815) for each of the spikes and each cable (815) is anchored to the payload body (105) so that the payload body (105) can be lowered to the cave floor in a controlled manner.

The spool (820) holds each cable (815). The spool (820) is adapted to unspool the cable (815) as commanded by the computer controller (210). Thus, the spool (820) unspools as the payload body (105) descends into the void space (825) to the floor of the cave.

In an alternative embodiment, the device (100) includes a means to right itself if it tips over in an underground cave or space. For example, such means may include fold-out side legs that pivot to right the device and hold itself steady to drill a new down hole.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the instrumentation industry.

What is claimed is:

1. A device that digs a payload into a geologic formation while filling a hole behind it, the device comprising:

a computer controller;

a battery supplying power to the computer controller;

a motor powered through the battery and controlled by the computer controller;

a payload body defining an enclosed hollow internal structure adapted to contain and support a payload, the computer controller, the battery and the motor, the payload body having an outer diameter, a top end and a bottom end;

a drill head comprising a conical shape rising from a pointed end, the drill head rotatably mounted to the motor at the bottom end of the payload body, the drill head comprising a spiral blade on an outer peripheral surface of the conical shape, the spiral blade starting at the pointed end and rising toward the payload body;

a cylindrical shell attached to the payload body and having an inner diameter larger than the outer diameter and extending from the bottom end of the payload body to terminate near the top end of the payload body so that the cylindrical shell surrounds the payload body, the cylindrical shell forming an annulus between an inner wall of the cylindrical shell and an outer wall of the payload body, the annulus configured to surround the payload body and receive debris from the spiral blade; and a plurality of rotating track treads controlled by the computer controller, the plurality of rotating track treads mounted vertically to the cylindrical shell and adapted to extend radially outward from within a recess of an outside wall of the cylindrical shell to engage any geologic formation surrounding the cylindrical shell so as to propel the drill head at least in a downward direction.

2. The device of claim 1, further comprising a hydraulic ram controlled by the computer controller, the hydraulic ram extending from the top end of the payload body, the hydraulic ram adapted to compress debris exiting from the annulus.

3. The device of claim 1, further comprising a coil of wire adapted to unwind from the top end of the payload body, the wire adapted to provide electrical power to the battery and the motor, the wire further adapted to provide a connection for sending instructions to the computer controller.

4. The device of claim 1, further comprising a hammer blade extendable from a slot in the drill head, the hammer blade adapted to be partially extended in and out of the drill head so as to engage the geologic formation.

5. The device of claim 1, further comprising ground penetrating radar controlled by the computer controller.

6. The device of claim 1, further comprising a gimbal mechanism mounted between the motor and the pointed end of the drill head and adapted to tilt the drill head upon a command received from the computer controller.

7. The device of claim 1, further comprising an engine-generator unit within the payload body, the engine-generator unit configured to generate electricity and supply power to the battery upon activation by the computer controller; the engine-generator unit comprising a gaseous exhaust outside the payload body, a fuel tank within the payload body, the fuel tank adapted to supply fuel to the engine-generator unit; and an oxygen tank within the payload body, the oxygen tank adapted to supply oxygen to the engine-generator unit.

8. The device of claim 1, further comprising a cave traverse system, the cave traverse system comprising:

a sensor connected to the computer controller, the sensor adapted to indicate when the drill head has entered a void space;

at least two spikes adapted to be deployed into the geological formation at about 90 degrees from the downward direction of the payload body after the sensor has indicated to the computer controller that the drill head has entered the void space;

a cable attached to each of the spikes and anchored to the payload body; and a spool holding the cable and adapted to unspool the cable as the payload body descends into the void space.

* * * * *